US010482804B2

(12) United States Patent
Kong et al.

(10) Patent No.: US 10,482,804 B2
(45) **Date of Patent: *Nov. 19, 2019**

(54) DISPLAY SOURCE DRIVER

(71) Applicant: SAMSUNG ELECTRONICS CO., LTD., Suwon-si, Gyeonggi-do (KR)

(72) Inventors: Ki-Ho Kong, Suwon-si (KR); Dong-Wook Suh, Bucheon-si (KR); Hee-Jong Kim, Seoul (KR); Chang-Hee Shin, Gimpo-si (KR); Hyeok-Chul Kwon, Hwaseong-si (KR); Hong-Keun Yune, Seoul (KR)

(73) Assignee: SAMSUNG ELECTRONIC CO., LTD., Suwon-si, Gyeonggi-Do (KR)

( * ) Notice: Subject to any disclaimer, the term of this patent is extended or adjusted under 35 U.S.C. 154(b) by 73 days.

This patent is subject to a terminal disclaimer.

(21) Appl. No.: 15/682,021

(22) Filed: Aug. 21, 2017

(65) Prior Publication Data

US 2017/0345357 A1 Nov. 30, 2017

Related U.S. Application Data

(63) Continuation of application No. 15/006,618, filed on Jan. 26, 2016, now Pat. No. 9,741,280.

(30) Foreign Application Priority Data

Apr. 30, 2015 (KR) ..... 10-2015-0061055

(51) Int. Cl.
*G09G 5/02* (2006.01)
*G09G 3/20* (2006.01)

(52) U.S. Cl.
CPC ... *G09G 3/2003* (2013.01); *G09G 2300/0452* (2013.01); *G09G 2310/027* (2013.01);
(Continued)

(58) Field of Classification Search
CPC ..... G09G 3/2003; G09G 2330/028; G09G 2310/0297; G09G 2310/027; G09G 2300/0452; G09G 2320/0673
See application file for complete search history.

(56) References Cited

U.S. PATENT DOCUMENTS 7,209,105 B2 4/2007 Elliott
7,746,310 B2 6/2010 Ahn
(Continued)

FOREIGN PATENT DOCUMENTS

KR 1020130092264 8/2013
KR 1020130107559 10/2013
(Continued)

*Primary Examiner* — Adam R. Giesy
(74) *Attorney, Agent, or Firm* — F. Chau & Associates, LLC

(57) ABSTRACT

A source driver for a display device includes a gamma voltage generation circuit, first through (2m)-th data driving circuits, and a switch circuit. The gamma voltage generation circuit generates R, G and B gamma voltages. The (2k−1)-th data driving circuits consecutively receive red image data and blue image data, and consecutively generate a R driving voltage and a B driving voltage using the R gamma voltages and B gamma voltages, respectively, during one horizontal period. The (2k)-th data driving circuits consecutively receive first green image data and second green image data, and consecutively generate a G1 driving voltage and a G2 driving voltage, respectively, using the G gamma voltages during the one horizontal period. The switch circuit outputs the R, B, G1, and G2 driving voltages through different data lines from each other based on a first selection signal and a second selection signal.

18 Claims, 12 Drawing Sheets

(52) U.S. Cl.
CPC ..... *G09G 2310/0297* (2013.01); *G09G 2320/0673* (2013.01); *G09G 2330/028* (2013.01)

(56) References Cited

U.S. PATENT DOCUMENTS

| | | | |
|---|---|---|---|
| 8,743,103 | B2 | 6/2014 | Lin et al. |
| 2013/0207940 | A1 | 8/2013 | Song et al. |
| 2014/0092076 | A1 | 4/2014 | Lee |
| 2014/0160172 | A1 | 6/2014 | Lee |
| 2014/0240379 | A1 | 8/2014 | Jeong et al. |
| 2014/0267472 | A1 | 9/2014 | Hsu et al. |
| 2016/0321977 | A1 | 11/2016 | Kong et al. |

FOREIGN PATENT DOCUMENTS

| | | |
|---|---|---|
| KR | 1020140075513 | 6/2014 |
| KR | 1020140107038 | 9/2014 |
| KR | 1020140137501 | 12/2014 |

DISPLAY SOURCE DRIVER

CROSS-REFERENCE TO RELATED APPLICATIONS

This application is a continuation of co-pending U.S. patent application Ser. No. 15/006,618, filed on Jan. 26, 2016 in the United States Patent and Trademark Office (USPTO), which claims priority under 35 USC § 119 to Korean Patent Application No. 10-2015-0061055, filed on Apr. 30, 2015 in the Korean Intellectual Property Office (KIPO), the contents of which are herein incorporated by reference in their entireties.

TECHNICAL FIELD

The present inventive concept relates to a display device, and more particularly to a source driver of a display device.

DISCUSSION OF RELATED ART

As the resolution of a display device increases, the size of a source driver for driving the display device generally increases. To reduce the size of the source driver, each of the source amplifiers included in the source driver may drive a plurality of data lines.

For the source amplifier to drive a plurality of data lines, the source amplifier is used to output data having different colors in each horizontal period. Therefore, power consumption of the display device may increase.

SUMMARY

An exemplary embodiment is directed to a source driver that decreases power consumption. An exemplary embodiment is directed to a display device including the source driver.

According to an exemplary embodiment, a source driver of a display device includes a gamma voltage generation circuit, odd numbered (2k−1)-th data driving circuits, even numbered (2k)-th data driving circuits, and a switch circuit. The gamma voltage generation circuit generates R gamma voltages, G gamma voltages, and B gamma voltages. The (2k−1)-th data driving circuits consecutively receive both red image data and blue image data during one horizontal period, and consecutively generate both a R driving voltage and a B driving voltage, which correspond to the red image data and the blue image data, using the R gamma voltages and B gamma voltages, respectively, during the one horizontal period. The (2k)-th data driving circuits consecutively receive both first green image data and second green image data during the one horizontal period, and consecutively generate both a G1 driving voltage and a G2 driving voltage, which correspond to the first green image data and the second green image data, respectively, using the G gamma voltages during the one horizontal period. Here, k represents all positive integers equal to or smaller than m, and m represents a positive integer. The switch circuit outputs the R driving voltage, the B driving voltage, the G1 driving voltage, and the G2 driving voltage, which are received from the first through (2m)-th data driving circuits during the one horizontal period, through different data lines from each other based on a first selection signal and a second selection signal.

In an exemplary embodiment, the first selection signal and the second selection signal may be activated alternately during the one horizontal period. In an exemplary embodiment, the switch circuit may output the R driving voltage and the B driving voltage, which are received from the (2i−1)-th data driving circuit during the one horizontal period, through a (4i−3)-th data line and a (4i−1)-th data line, respectively, based on the first selection signal and the second selection signal, and output the G1 driving voltage and the G2 driving voltage, which are received from the (2i)-th data driving circuit during the one horizontal period, through a (4i−2)-th data line and a (4i)-th data line, respectively, based on the first selection signal and the second selection signal. Here, i represents a positive integer equal to or smaller than m.

In an exemplary embodiment, the switch circuit may include first through (2m)-th demultiplexers coupled to the first through (2m)-th data driving circuits, respectively. Each of the first through (2m)-th demultiplexers may consecutively output two driving voltages, which are received from a corresponding data driving circuit during the one horizontal period, through different data lines from each other based on the first selection signal and the second selection signal.

The (2i−1)-th demultiplexer may include a first switch coupled between the (2i−1)-th data driving circuit and a (4i−3)-th data line, and turning on in response to the first selection signal, and a second switch coupled between the (2i−1)-th data driving circuit and a (4i−1)-th data line, and turning on in response to the second selection signal. The (2i)-th demultiplexer may include a third switch coupled between the (2i)-th data driving circuit and a (4i−2)-th data line, and turning on in response to the first selection signal, and a fourth switch coupled between the (2i)-th data driving circuit and a (4i)-th data line, and turning on in response to the second selection signal.

In an exemplary embodiment, the order in which each of the (2k−1)-th data driving circuits receives the red image data and the blue image data during an odd horizontal period may be opposite to the order in which each of the (2k−1)-th data driving circuits receives the red image data and the blue image data during an even horizontal period, and the order in which the first selection signal and the second selection signal are alternately activated during the odd horizontal period may be the same as the order in which the first selection signal and the second selection signal are alternately activated during the even horizontal period.

In an exemplary embodiment, the order in which each of the (2k−1)-th data driving circuits receives the red image data and the blue image data during an odd horizontal period may be the same as the order in which each of the (2k−1)-th data driving circuits receives the red image data and the blue image data during an even horizontal period, and the order in which the first selection signal and the second selection signal are alternately activated during the odd horizontal period may be opposite to the order in which the first selection signal and the second selection signal are alternately activated during the even horizontal period.

In an exemplary embodiment, the gamma voltage generation circuit may include a first gamma voltage generator configured to generate the R gamma voltages and the B gamma voltages alternately during the one horizontal period based on a logic level of a gamma selection signal, and to provide the R gamma voltages and the B gamma voltages to the (2k−1)-th data driving circuits, and a second gamma voltage generator configured to generate the G gamma voltages, and to provide the G gamma voltages to the (2k)-th data driving circuits.

In an exemplary embodiment, the gamma voltage generation circuit may include a first gamma voltage generator configured to generate the R gamma voltages, a second gamma voltage generator configured to generate the B gamma voltages, a third gamma voltage generator configured to generate the G gamma voltages, and to provide the G gamma voltages to the (2k)-th data driving circuits, and a multiplexer configured to provide one of the R gamma voltages and the B gamma voltages to the (2k−1)-th data driving circuits based on a logic level of a gamma selection signal.

The gamma selection signal may have a first logic level during a first half of the one horizontal period, and have a second logic level during a second half of the one horizontal period.

In an exemplary embodiment, the source driver may further include a data latch circuit configured to receive the red image data, the first green image data, the second green image data, and the blue image data, to consecutively provide the red image data and the blue image data to the (2k−1)-th data driving circuits during the one horizontal period, and to consecutively provide the first green image data and the second green image data to the (2k)-th data driving circuits during the one horizontal period.

According to an exemplary embodiment, a display device includes a display panel, a gate driver, a source driver, and a controller. The display panel includes red subpixels, green subpixels, and blue subpixels coupled to a plurality of gate lines and a plurality of data lines. The gate driver consecutively selects each of the plurality of gate lines. The source driver provides a plurality of driving voltages to the plurality of data lines. The controller controls the gate driver and the source driver, and provides image data to the source driver. The source driver includes data driving circuits, the number of which may be half of the number of the plurality of data lines. The first half of the data driving circuits generate consecutively during one horizontal period both a R driving voltage and a B driving voltage, which correspond to red image data and blue image data, respectively, that are consecutively received during the one horizontal period, and provide the R driving voltage and the B driving voltage consecutively to different data lines from each other to which the red subpixels and the blue subpixels are coupled. The second half of the data driving circuits generate consecutively during the one horizontal period both a G1 driving voltage and a G2 driving voltage, which correspond to first green image data and second green image data, respectively, that are consecutively received during the one horizontal period, and provide the G1 driving voltage and the G2 driving voltage consecutively to different data lines from each other to which the green subpixels are coupled.

In an exemplary embodiment, the display panel may have a pentile structure including odd rows, in which the red subpixels, the green subpixels, and the blue subpixels are arranged in an order of the red subpixel, the green subpixel, the blue subpixel, and the green subpixel, and even rows, in which the red subpixels, the green subpixels, and the blue subpixels are arranged in an order of the blue subpixel, the green subpixel, the red subpixel, and the green subpixel. The plurality of data lines may include first through (4m)-th data lines.

The source driver may include a gamma voltage generation circuit, (2k−1)-th data driving circuits, (2k)-th data driving circuits, and a switch circuit. The gamma voltage generation circuit may generate R gamma voltages, G gamma voltages, and B gamma voltages. The (2k−1)-th data driving circuits may consecutively receive both the red image data and the blue image data during the one horizontal period, and consecutively generate both the R driving voltage and the B driving voltage, which correspond to the red image data and the blue image data, using the R gamma voltages and B gamma voltages, respectively, during the one horizontal period. The (2k)-th data driving circuits may consecutively receive both the first green image data and the second green image data during the one horizontal period, and consecutively generate both the G1 driving voltage and the G2 driving voltage, which correspond to the first green image data and the second green image data, respectively, using the G gamma voltages during the one horizontal period. The switch circuit may output the R driving voltage, the B driving voltage, the G1 driving voltage, and the G2 driving voltage, which are received from the first through (2m)-th data driving circuits during the one horizontal period, through different data lines from each other based on a first selection signal and a second selection signal provided by the controller.

The switch circuit may output the R driving voltage and the B driving voltage, which are received from the (2i−1)-th data driving circuit during the one horizontal period, through a (4i−3)-th data line and a (4i−1)-th data line, respectively, based on the first selection signal and the second selection signal, and output the G1 driving voltage and the G2 driving voltage, which are received from the (2i)-th data driving circuit during the one horizontal period, through a (4i−2)-th data line and a (4i)-th data line, respectively, based on the first selection signal and the second selection signal.

An exemplary embodiment display driver circuit includes: a gamma voltage generation circuit configured to generate for each pixel of a display a red, a blue, and two green gamma voltages, the red and one green during a first portion of each horizontal period, and the blue and another green during a second portion of each horizontal period; a first plurality of data driving circuits configured to alternately receive red image data and blue image data during each horizontal period, and to alternately generate a red driving voltage based on the red image data and a blue driving voltage based on the blue image data, using the red and blue gamma voltages, respectively, during each horizontal period; and a second plurality of data driving circuits configured to alternately receive first green image data and second green image data during each horizontal period, and to alternately generate both a first green driving voltage based on the first green image data and a second green driving voltage based on the second green image data, respectively, using the first and second green gamma voltages, respectively, during each horizontal period.

BRIEF DESCRIPTION OF THE DRAWINGS

Illustrative, non-limiting exemplary embodiments of the present inventive concept will be more clearly understood from the following detailed description in conjunction with the accompanying drawings.

DETAILED DESCRIPTION

Figure 1:
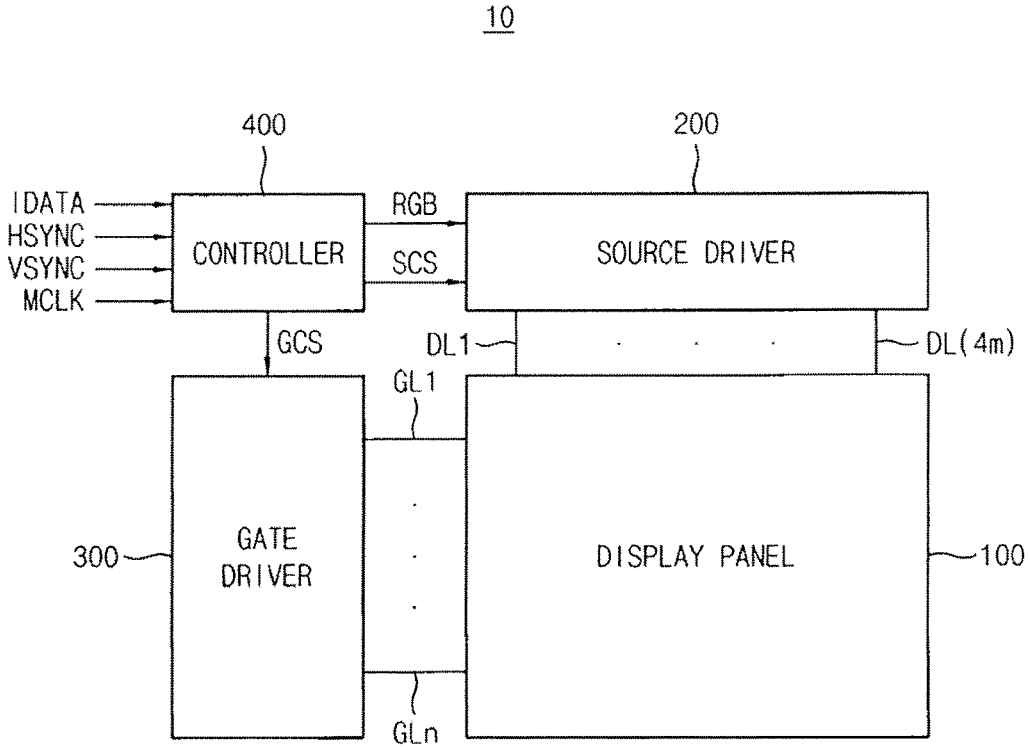
FIG. 1 is a block diagram illustrating a display device according to an exemplary embodiment.

The present inventive concept will be described more fully by way of example with reference to the accompanying drawings, in which exemplary embodiments are shown. The present inventive concept may, however, be embodied in many different forms and should not be construed as limited to the embodiments set forth herein. Rather, these embodiments are provided so that this disclosure will be thorough and complete, and will fully convey the scope of the present inventive concept to those skilled in the art. Like reference numerals may refer to like elements throughout this application.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments and is not intended to be limiting of the inventive concept. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a display device according to an exemplary embodiment.

Referring to FIG. 1, a display device 10 includes a display panel 100, display drivers including a source driver 200 and a gate driver 300, and a controller 400.

The display panel 100 may include red subpixels, green subpixels, and blue subpixels coupled to a plurality of gate lines GL1~GLn and a plurality of data lines DL1~DL(4m). Here, the pixel resolution of the display may me m columns by n rows, for example, where n and m represent positive integers.

Figure 2:
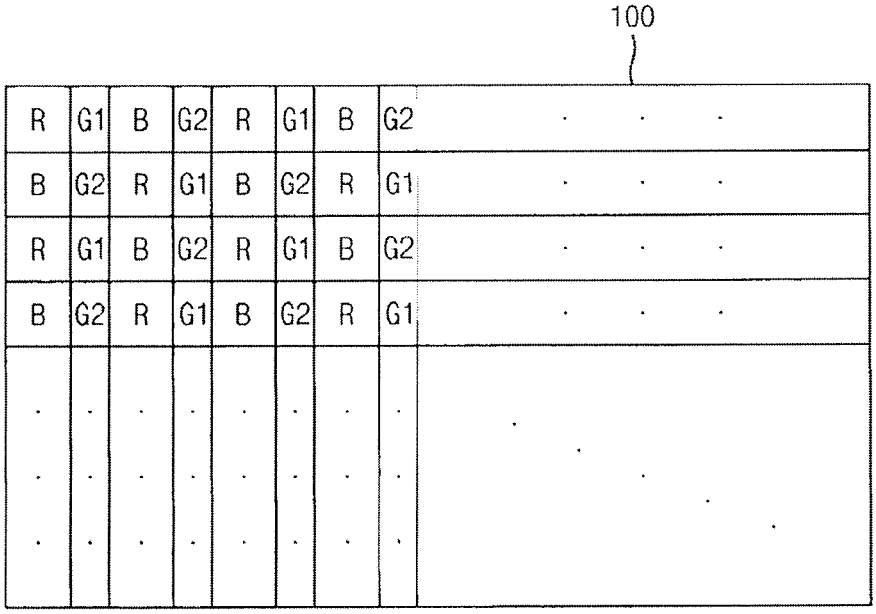
FIG. 2 is a schematic diagram illustrating an exemplary embodiment display panel included in the display device of FIG. 1.

FIG. 2 is a diagram illustrating an example of a display panel included in the display device of FIG. 1.

As illustrated in FIG. 2, the display panel 100 may have a pentile structure. An exemplary pentile structure may be a subpixel structure with two or four subpixels per pixel and twice as many green subpixels (G1, G2) than red (R) or blue (B) subpixels arranged in a repeating RGBG pattern. For example, the display panel 100 may have a subpixel structure of two or four subpixels per pixel arranged in a 2×1 or 4×1 array for each row or horizontal period, respectively, or four subpixels per pixel arranged in a 2×2 array split over two rows or horizontal periods. The display panel 100 may include odd rows, in which the red subpixels R, the green subpixels G1 and G2, and the blue subpixels B are arranged in an order of the red subpixel R, the first green subpixel G1, the blue subpixel B, and the second green subpixel G2, and even rows, in which the red subpixels R, the green subpixels G1 and G2, and the blue subpixels B are arranged in an order of the blue subpixel B, the second green subpixel G2, the red subpixel R, and the first green subpixel G1.

Therefore, the display panel 100 may include (4*m) columns coupled to the plurality of data lines DL1~DL(4m), respectively. In addition, the red subpixels R and the blue subpixels B may be alternately coupled to odd data lines, and the first green subpixel G1 and the second green subpixel G2 may be alternately coupled to even data lines.

Thus, a display driver circuit may have the first and second groups of subpixels substantially equal in number, where the first group is connected to odd numbered data driving circuits for driving odd numbered data lines, and the second group is connected to even numbered data driving circuits for driving even numbered data lines. Alternatively, the second group may be connected to odd numbered data driving circuits for driving odd numbered data lines, and the first group may be connected to even numbered data driving circuits for driving even numbered data lines, without limitation.

Referring again to FIG. 1, the controller 400 may receive input data IDATA, a horizontal synchronization signal HSYNC, a vertical synchronization signal VSYNC, and a main clock signal MCLK.

The controller 400 may generate a gate control signal GCS and a source control signal SCS based on the horizontal synchronization signal HSYNC, the vertical synchronization signal VSYNC, and the main clock signal MCLK.

In addition, the controller 400 may divide the input data IDATA in a unit of a frame based on the vertical synchronization signal VSYNC, and divide the input data IDATA in a unit of a gate line based on the horizontal synchronization signal HSYNC to generate image data RGB.

In an exemplary embodiment, the image data RGB may include red image data R_D corresponding to the red subpixels R, first green image data G1_D corresponding to the first green subpixels G1, second green image data G2_D corresponding to the second green subpixels G2, and blue image data B D corresponding to the blue subpixels B.

The controller 400 may provide the gate control signal GCS to the gate driver 300, and provide the source control signal SCS and the image data RGB to the source driver 200.

The gate driver 300 may be coupled to the display panel 100 through the plurality of gate lines GL1~GLn. The gate driver 300 may consecutively select the plurality of gate lines GL1~GLn based on the gate control signal GCS.

The source driver 200 may be coupled to the display panel 100 through the plurality of data lines DL1~DL(4m). The source driver 200 may generate a plurality of driving voltages by processing the image data RGB based on the source control signal SCS, and provide the plurality of driving voltages to the display panel 100 through the plurality of data lines DL1~DL(4m).

For example, the source driver 200 may generate a R driving voltage R_DV corresponding to the red image data R_D, a G1 driving voltage G1_DV corresponding to the first green image data G1_D, a G2 driving voltage G2_DV corresponding to the second green image data G2_D, and a B driving voltage B_DV corresponding to the blue image data B_D, and provide the R driving voltage R_DV, the G1 driving voltage G1_DV, the G2 driving voltage G2_DV, and the B driving voltage B_DV to the red subpixel R, the first green subpixel G1, the second green subpixel G2, and the blue subpixel B of the display panel 100, respectively, through the plurality of data lines DL1~DL(4m).

In an exemplary embodiment, the source driver 200 may include data driving circuits. The number of the data driving circuits may be half of the number of the plurality of data lines DL1~DL(4m). That is, the number of the data driving circuits included in the source driver 200 may be (2*m).

The first half of the data driving circuits may consecutively receive the red image data R_D and the blue image data B_D during one horizontal period, consecutively generate the R driving voltage R_DV and the B driving voltage B_DV, which correspond to the red image data R_D and the blue image data B_D, respectively, during the one horizontal period, and consecutively provide the R driving voltage R_DV and the B driving voltage B_DV to different data lines from each other to which the red subpixels R and the blue subpixels B are coupled. For example, the first half of the data driving circuits may consecutively provide the R driving voltage R_DV and the B driving voltage B_DV, which are consecutively generated during the one horizontal period, to two adjacent odd data lines to which the red subpixels R and the blue subpixels B are coupled.

In addition, the second half of the data driving circuits may consecutively receive the first green image data G1_D and the second green image data G2_D during the one horizontal period, consecutively generate the G1 driving voltage G1_DV and the G2 driving voltage G2_DV, which correspond to the first green image data G1_D and the second green image data G2_D, respectively, during the one horizontal period, and consecutively provide the G1 driving voltage G1_DV and the G2 driving voltage G2_DV to different data lines from each other to which the first green subpixels G1 and the second green subpixels G2 are coupled. For example, the second half of the data driving circuits may consecutively provide the G1 driving voltage G1_DV and the G2 driving voltage G2_DV, which are consecutively generated during the one horizontal period, to two adjacent even data lines to which the first green subpixels G1 and the second green subpixels G2 are coupled.

Generally, red driving voltage corresponding to red color, green driving voltage corresponding to green color, and blue driving voltage corresponding to blue color are generated using gamma voltages in different voltage ranges. Therefore, if a data driving circuit included in a source driver generates driving voltages corresponding to different colors alternately, power consumption of the source driver may be high.

On the other hand, as described above, the source driver 200 included in the display device 10 according to an exemplary embodiment may include (2*m) data driving circuits, the number of which is half of the number of the plurality of data lines DL1~DL(4m). Each of the data driving circuits may generate two driving voltages during one horizontal period, and provide the two driving voltage to two different data lines. The first half of the data driving circuits may output the R driving voltage R_DV corresponding to red color and the B driving voltage B_DV corresponding to blue color alternately during each horizontal period. However, the second half of the data driving circuits may output the G1 driving voltage G1_DV and the G2 driving voltage G2_DV, both of which correspond to green color, during each horizontal period. Therefore, power consumption of the source driver 200 may decrease and the size of the source driver 200 may also decrease.

Figure 3:
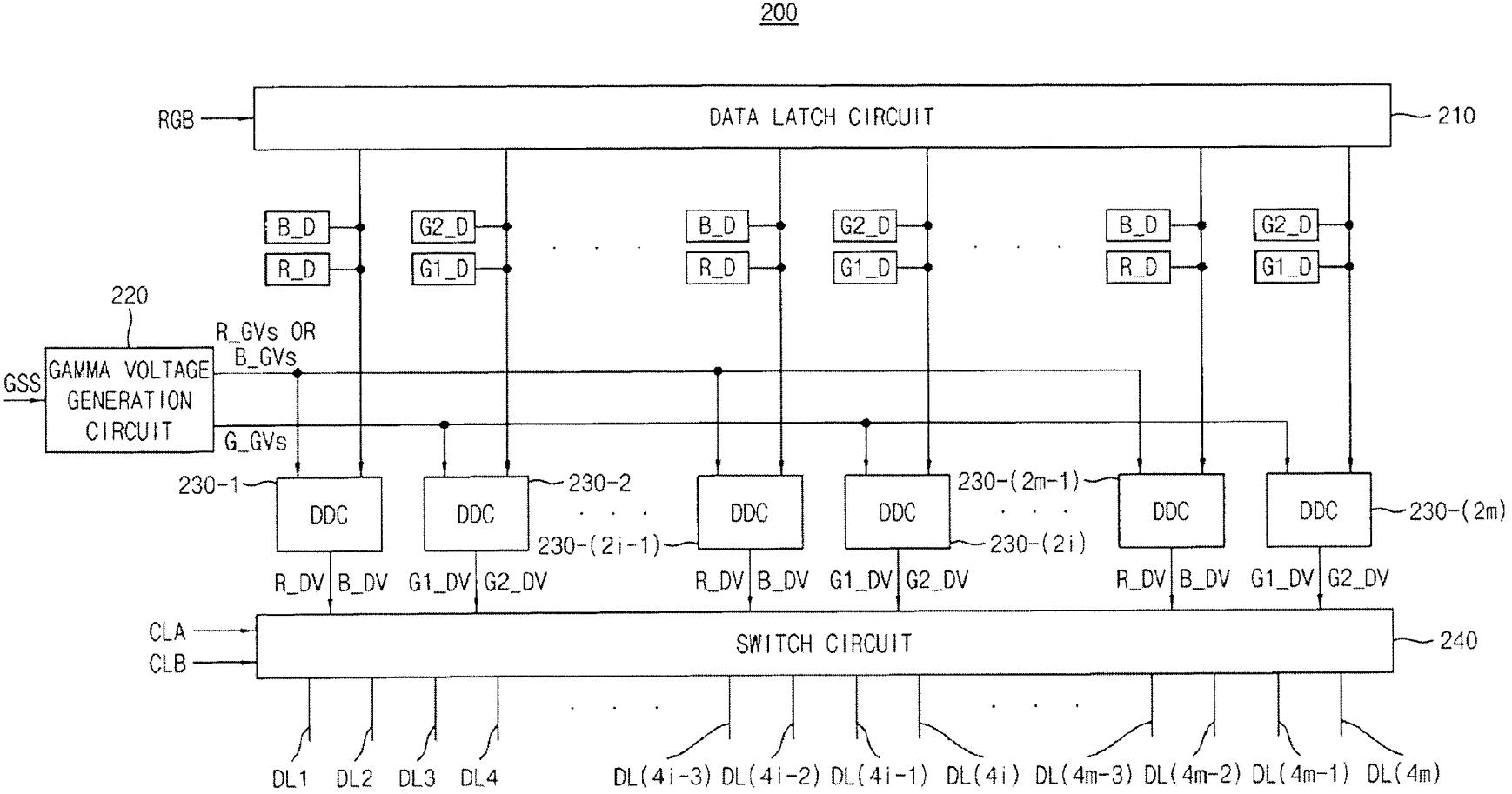
FIG. 3 is a block diagram illustrating an exemplary embodiment source driver included in the display device of FIG. 1.

FIG. 3 is a block diagram illustrating an example of a source driver included in the display device of FIG. 1.

Referring to FIG. 3, the source driver 200 may include a data latch circuit 210, a gamma voltage generation circuit 220, first through (2m)-th data driving circuits DDC 230-1~230-(2m), and a switch circuit 240.

In the exemplary embodiment for FIG. 2, the switch may activate once per horizontal period. Alternatively, at least a portion of the switch may activate once per every two horizontal periods, without limitation. Once per horizontal period may output RBRB for an odd (2k−1)-th data line over four periods, for example, while once per every two horizontal periods may output RBBR for the odd data line over four periods, for example. Similarly, once per horizontal period may output G1G2G1G2 for an even (2k)-th data line over four periods, for example, while once per every two horizontal periods may output G1G2G2G1 for the even data line over four periods, for example.

The data latch circuit 210 may receive the image data RGB including the red image data R_D, the first green image data G1_D, the second green image data G2_D, and the blue image data B_D from the controller 400, and latch the image data RGB. The data latch circuit 210 may consecutively provide the red image data R_D and the blue image data B_D to the (2k−1)-th data driving circuits 230-(2k−1) during each horizontal period, and consecutively provide the first green image data G1_D and the second green image data G2_D to the (2k)-th data driving circuits 230-(2k) during each horizontal period. Here, k represents all positive integers equal to or smaller than m.

The gamma voltage generation circuit 220 may generate R gamma voltages R_GVs corresponding to red color, G gamma voltages G_GVs corresponding to green color, and B gamma voltages B_GVs corresponding to blue color.

In an exemplary embodiment, the gamma voltage generation circuit 220 may provide one of the R gamma voltages R_GVs and the B gamma voltages B_GVs to the (2k−1)-th data driving circuits 230-(2k−1) based on a logic level of a gamma selection signal GSS provided by the controller 400. For example, the gamma voltage generation circuit 220 may provide the R gamma voltages R_GVs to the (2k−1)-th data driving circuits 230-(2k−1) while the data latch circuit 210 provides the red image data R_D to the (2k−1)-th data driving circuits 230-(2k−1). Alternately, the gamma voltage generation circuit 220 may provide the B gamma voltages B_GVs to the (2k−1)-th data driving circuits 230-(2k−1) while the data latch circuit 210 provides the blue image data B_D to the (2k−1)-th data driving circuits 230-(2k−1).

In addition, the gamma voltage generation circuit 220 may provide the G gamma voltages G_GVs to the (2k)-th data driving circuits 230-(2k).

In an exemplary embodiment display driver circuit, a gamma voltage generation circuit is configured to generate for each pixel of a display a red, a blue, and two green gamma voltages, the red and one green during a first portion of each horizontal period, and the blue and another green during a second portion of each horizontal period. A first group of data driving circuits is configured to alternately receive red image data and blue image data during each horizontal period, and to alternately generate a red driving voltage based on the red image data and a blue driving voltage based on the blue image data, using the red and blue gamma voltages, respectively, during each horizontal period. A second group of data driving circuits is configured to alternately receive first green image data and second green image data during each horizontal period, and to alternately generate both a first green driving voltage based on the first green image data and a second green driving voltage based on the second green image data, respectively, using the first and second green gamma voltages, respectively, during each horizontal period.

Figure 4:
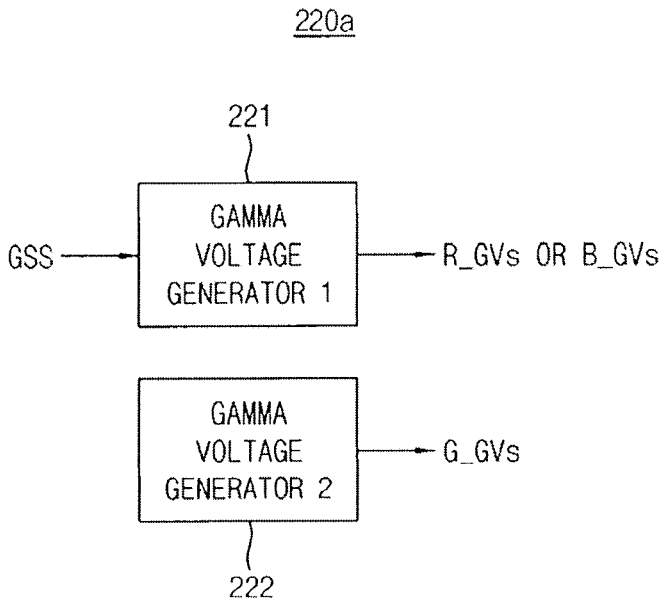
FIG. 4 is a block diagram illustrating an exemplary embodiment gamma voltage generation circuit included in the source driver of FIG. 3.

FIG. 4 is a block diagram illustrating an example of a gamma voltage generation circuit included in the source driver of FIG. 3.

Referring to FIG. 4, a gamma voltage generation circuit 220*a* may include a first gamma voltage generator 221 and a second gamma voltage generator 222.

The first gamma voltage generator 221 may generate the R gamma voltages R_GVs and the B gamma voltages B_GVs alternately during one horizontal period based on the logic level of the gamma selection signal GSS, and provide the R gamma voltages R_GVs and the B gamma voltages B_GVs to the (2k−1)-th data driving circuits 230-(2k−1). In an exemplary embodiment, the gamma selection signal GSS may have a first logic level during a first half of one horizontal period, and have a second logic level during a second half of one horizontal period.

Thus, in a display driver circuit, the first switch may receive the red or blue driving voltages alternately through different data lines in response to a first selection signal, and the second switch may receive the first green or second green driving voltages alternately through different data lines in response to a second selection signal.

The second gamma voltage generator 222 may continuously generate the G gamma voltages G_GVs during one horizontal period, and provide the G gamma voltages G_GVs to the (2k)-th data driving circuits 230-(2k).

As described above with reference to FIG. 4, since the gamma voltage generation circuit 220*a* generates the R gamma voltages R_GVs, the B gamma voltages B_GVs, and the G gamma voltages G_GVs using two gamma voltage generators 221 and 222, the gamma voltage generation circuit 220*a* may be implemented in a small size.

Figure 5:
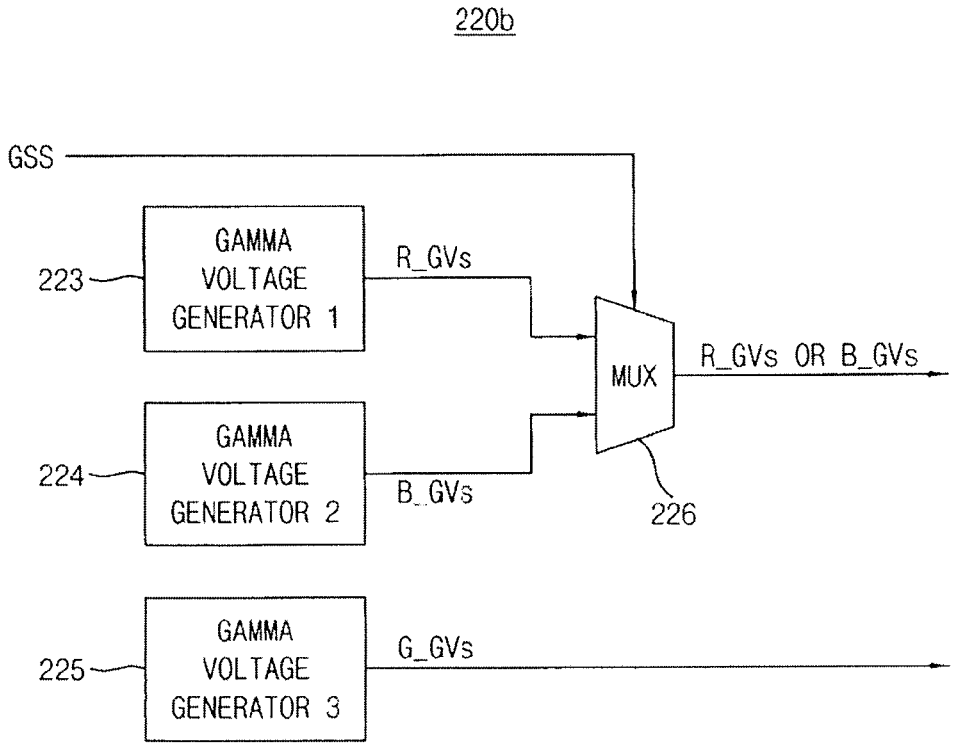
FIG. 5 is a block diagram illustrating an exemplary embodiment gamma voltage generation circuit included in the source driver of FIG. 3.

FIG. 5 is a block diagram illustrating another example of a gamma voltage generation circuit included in the source driver of FIG. 3.

Referring to FIG. 5, a gamma voltage generation circuit 220*b* may include a first gamma voltage generator 223, a second gamma voltage generator 224, a third gamma voltage generator 225, and a multiplexer MUX 226.

Thus, a display driver circuit may include a multiplexer in any of the gamma voltage generation circuits configured to alternate between first and second gamma voltages during the first and second portions of each horizontal period, respectively.

The first gamma voltage generator 223 may continuously generate the R gamma voltages R_GVs during one horizontal period. The second gamma voltage generator 224 may continuously generate the B gamma voltages B_GVs during one horizontal period. The third gamma voltage generator 225 may continuously generate the G gamma voltages G_GVs during one horizontal period.

The multiplexer 226 may receive the R gamma voltages R_GVs from the first gamma voltage generator 223, and receive the B gamma voltages B_GVs from the second gamma voltage generator 224. The multiplexer 226 may provide one of the R gamma voltages R_GVs and the B gamma voltages B_GVs to the (2k−1)-th data driving circuits 230-(2k−1) based on the logic level of the gamma selection signal GSS. In an exemplary embodiment, the gamma selection signal GSS may have a first logic level during a first half of one horizontal period, and have a second logic level during a second half of one horizontal period.

The third gamma voltage generator 225 may provide the G gamma voltages G_GVs to the (2k)-th data driving circuits 230-(2k).

As described above with reference to FIG. 5, since each of the first through third gamma voltage generator 221, 222 and 223 included in the gamma voltage generation circuit 220*b* continuously generates the same gamma voltages during one horizontal period instead of alternately generating the R gamma voltages R_GVs, the B gamma voltages B_GVs, and the G gamma voltages G_GVs, power consumption of the gamma voltage generation circuit 220*b* may be low.

Referring again to FIG. 3, each of the (2k−1)-th data driving circuits 230-(2k−1) may consecutively receive the red image data R_D and the blue image data B_D from the data latch circuit 210 during one horizontal period. When each of the (2k−1)-th data driving circuits 230-(2k−1) receives the red image data R_D from the data latch circuit 210, each of the (2k−1)-th data driving circuits 230-(2k−1) may generate the R driving voltage R_DV, which corresponds to the red image data R_D, using the R gamma voltages R_GVs. When each of the (2k−1)-th data driving circuits 230-(2k−1) receives the blue image data B_D from the data latch circuit 210, each of the (2k−1)-th data driving circuits 230-(2k−1) may generate the B driving voltage B_DV, which corresponds to the blue image data B_D, using the B gamma voltages B_GVs. Therefore, each of the (2k−1)-th data driving circuits 230-(2k−1) may consecutively generate the R driving voltage R_DV and the B driving voltage B_DV during one horizontal period.

Each of the (2k)-th data driving circuits 230-(2k) may consecutively receive the first green image data G1_D and the second green image data G2_D from the data latch circuit 210 during one horizontal period. Each of the (2k)-th data driving circuits 230-(2k) may consecutively generate the G1 driving voltage G1_DV and the G2 driving voltage G2_DV, which correspond to the first green image data G1_D and the second green image data G2_D, respectively, using the G gamma voltages G_GVs.

Figure 6:
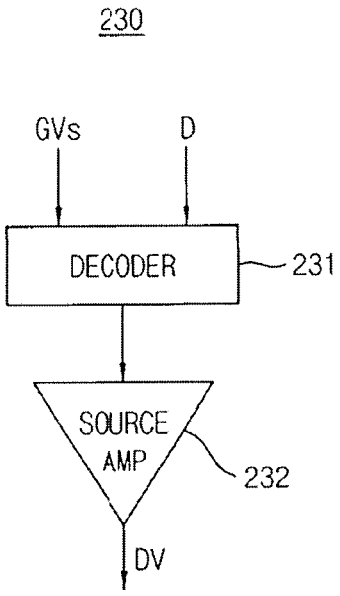
FIG. 6 is a block diagram illustrating an exemplary embodiment data driving circuit included in the source driver of FIG. 3.

FIG. 6 is a block diagram illustrating an example of a data driving circuit included in the source driver of FIG. 3.

Each of the first through (2m)-th data driving circuits 230-1~230-(2m) included in the source driver 300 of FIG. 3 may be implemented with a data driving circuit 230 of FIG. 6.

Referring to FIG. 6, the data driving circuit 230 may include a decoder 231 and a source amplifier 232.

The decoder 231 may receive gamma voltages GVs from the gamma voltage generation circuit 220, and receive color image data D from each of the first through (2m)-th data driving circuits 230-1~230-(2m). Here, the gamma voltages GVs may correspond to one of the R gamma voltages R_GVs, the G gamma voltages G_GVs, and the B gamma voltages B_GVs, and the color image data D may correspond to one of the red image data R_D, the first green image data G1_D, the second green image data G2_D, and the blue image data B_D.

The decoder 231 may output one of the gamma voltages GVs based on the color image data D.

The source amplifier 232 may generate a driving voltage DV by amplifying a voltage provided by the decoder 231. When the color image data D corresponds to the red image data R_D, the driving voltage DV may correspond to the R driving voltage R_DV, when the color image data D corresponds to the first green image data G1_D, the driving voltage DV may correspond to the G1 driving voltage G1_DV, when the color image data D corresponds to the second green image data G2_D, the driving voltage DV may correspond to the G2 driving voltage G2_DV, and when the color image data D corresponds to t the blue image data B_D, the driving voltage DV may correspond to the B driving voltage B_DV.

The data driving circuit 230 illustrated in FIG. 6 is an example of each of the first through (2m)-th data driving circuits 230-1~230-(2m) included in the source driver 300 of FIG. 3. Exemplary embodiments are not limited thereto. Each of the first through (2m)-th data driving circuits 230-1~230-(2m) may be implemented in various structures.

Referring again to FIG. 3, the switch circuit 240 may receive a first selection signal CLA and a second selection signal CLB from the controller 400.

In an exemplary embodiment, the first selection signal CLA and the second selection signal CLB may be activated alternately during one horizontal period. That is, a period during which the first selection signal CLA is activated may be not overlapped with a period during which the second selection signal CLB is activated.

The switch circuit 240 may output the R driving voltage R_DV, the B driving voltage B_DV, the G1 driving voltage G1_DV, and the G2 driving voltage G2_DV, which are received from the first through (2m)-th data driving circuits 230-1~230-(2m) during one horizontal period, through different data lines from each other based on the first selection signal CLA and the second selection signal CLB.

For example, the switch circuit 240 may consecutively output the R driving voltage R_DV and the B driving voltage B_DV, which are received from the (2k−1)-th data driving circuits 230-(2k−1) during one horizontal period, to two adjacent odd data lines to which the red subpixels R and the blue subpixels B are coupled. In addition, the switch circuit 240 may consecutively output the G1 driving voltage G1_DV and the G2 driving voltage G2_DV, which are received from the (2k)-th data driving circuits 230-(2k) during one horizontal period, to two adjacent even data lines to which the first green subpixel G1 and the second green subpixel G2 are coupled.

Thus, a display driver circuit may include a first switch circuit configured to output the red driving voltage and the blue driving voltage received from the first group of data driving circuits during separate portions of each horizontal period, and a second switch configured to output the first green driving voltage and the second green driving voltage received from the second group of data driving circuits during separate portions of each horizontal period.

Figure 7:
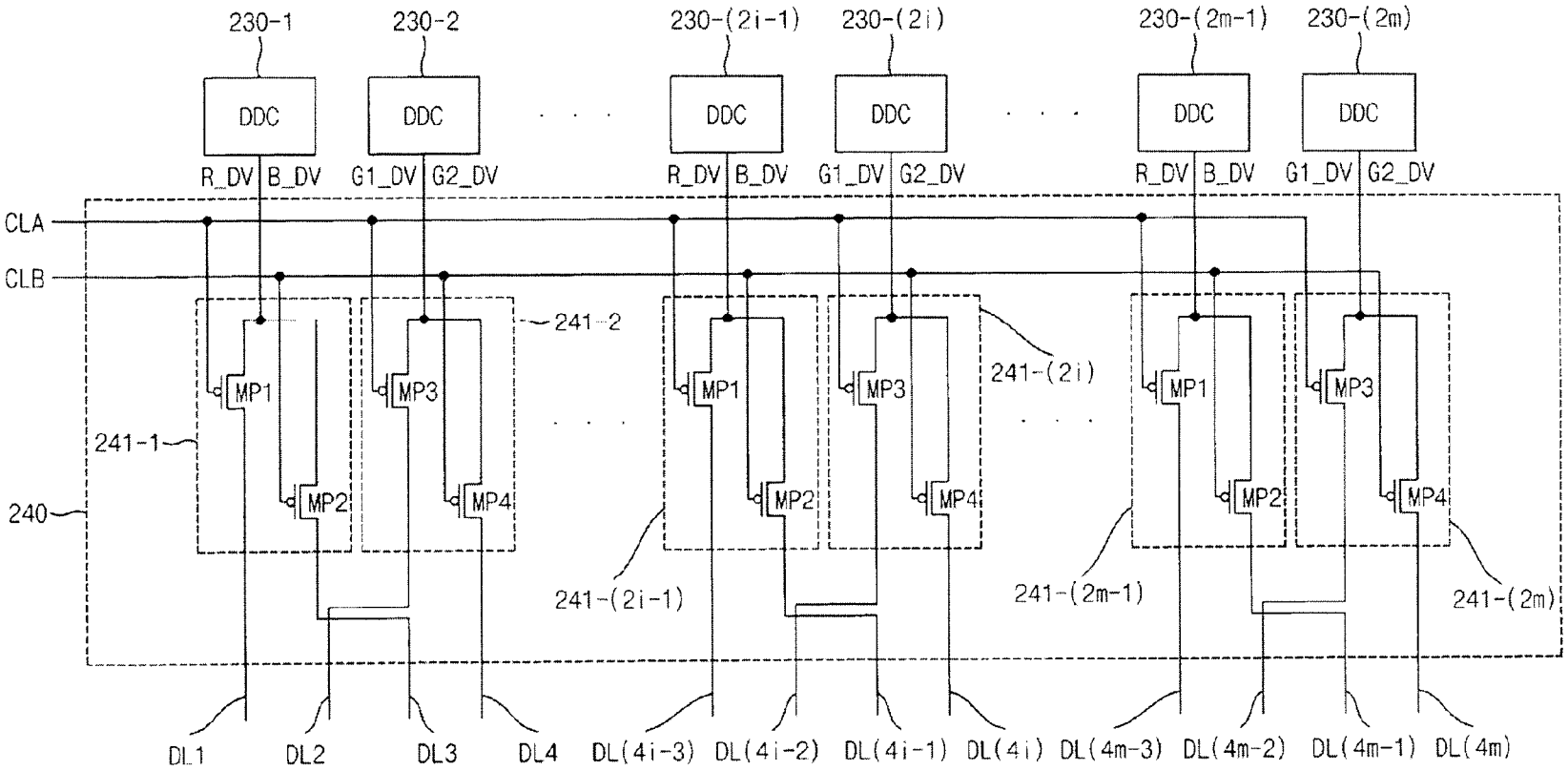
FIG. 7 is a circuit diagram illustrating an exemplary embodiment switch circuit included in the source driver of FIG. 3.

FIG. 7 is a block diagram illustrating an example of a switch circuit included in the source driver of FIG. 3.

Referring to FIG. 7, the switch circuit 240 may include first through (2m)-th demultiplexers 241-1~241-(2m).

The first through (2m)-th demultiplexers 241-1~241-(2m) may be coupled to the first through (2m)-th data driving circuits 230-1~230-(2m), respectively.

The (2i−1)-th demultiplexer 241-(2i−1) may include a first switch MP1 and a second switch MP2. Here, i represents a positive integer equal to or smaller than m.

The first switch MP1 may be coupled between the (2i−1)-th data driving circuit 230-(2i−1) and a (4i−3)-th data line DL(4i−3). The first switch MP1 may turn on in response to the first selection signal CLA.

The second switch MP2 may be coupled between the (2i−1)-th data driving circuit 230-(2i−1) and a (4i−1)-th data line DL(4i−1). The second switch MP2 may turn on in response to the second selection signal CLB.

The (2i)-th demultiplexer 241-(2i) may include a third switch MP3 and a fourth switch MP4.

The third switch MP3 may be coupled between the (2i)-th data driving circuit 230-(2i) and a (4i−2)-th data line DL(4i−2). The third switch MP3 may turn on in response to the first selection signal CLA.

The fourth switch MP4 may be coupled between the (2i)-th data driving circuit 230-(2i) and a (4i)-th data line DL(4i). The fourth switch MP4 may turn on in response to the second selection signal CLB.

In an exemplary embodiment, as illustrated in FIG. 7, each of the first through fourth switches MP1, MP2, MP3 and MP4 may include a p-type metal oxide semiconductor (PMOS) transistor.

As described above, the first selection signal CLA and the second selection signal CLB may be activated alternately during one horizontal period. That is, a period during which the first selection signal CLA is activated may be not overlapped with a period during which the second selection signal CLB is activated.

Therefore, each of the first through (2m)-th demultiplexers 241-1~241-(2m) may consecutively output two driving voltages, which are received from a corresponding data driving circuit during one horizontal period, through different data lines from each other based on the first selection signal CLA and the second selection signal CLB.

For example, based on the first selection signal CLA and the second selection signal CLB, the switch circuit 240 may consecutively output the R driving voltage R_DV and the B driving voltage B_DV, which are consecutively received from the (2i−1)-th data driving circuit 230-(2i−1) during one horizontal period, through the (4i−3)-th data line DL(4i−3) and the (4i−1)-th data line DL(4i−1), respectively, and consecutively output the G1 driving voltage G1_DV and the G2 driving voltage G2_DV, which are consecutively received from the (2i)-th data driving circuit 230-(2i) during one horizontal period, through the (4i−2)-th data line DL(4i−2) and the (4i)-th data line DL(4i), respectively.

Figure 8:
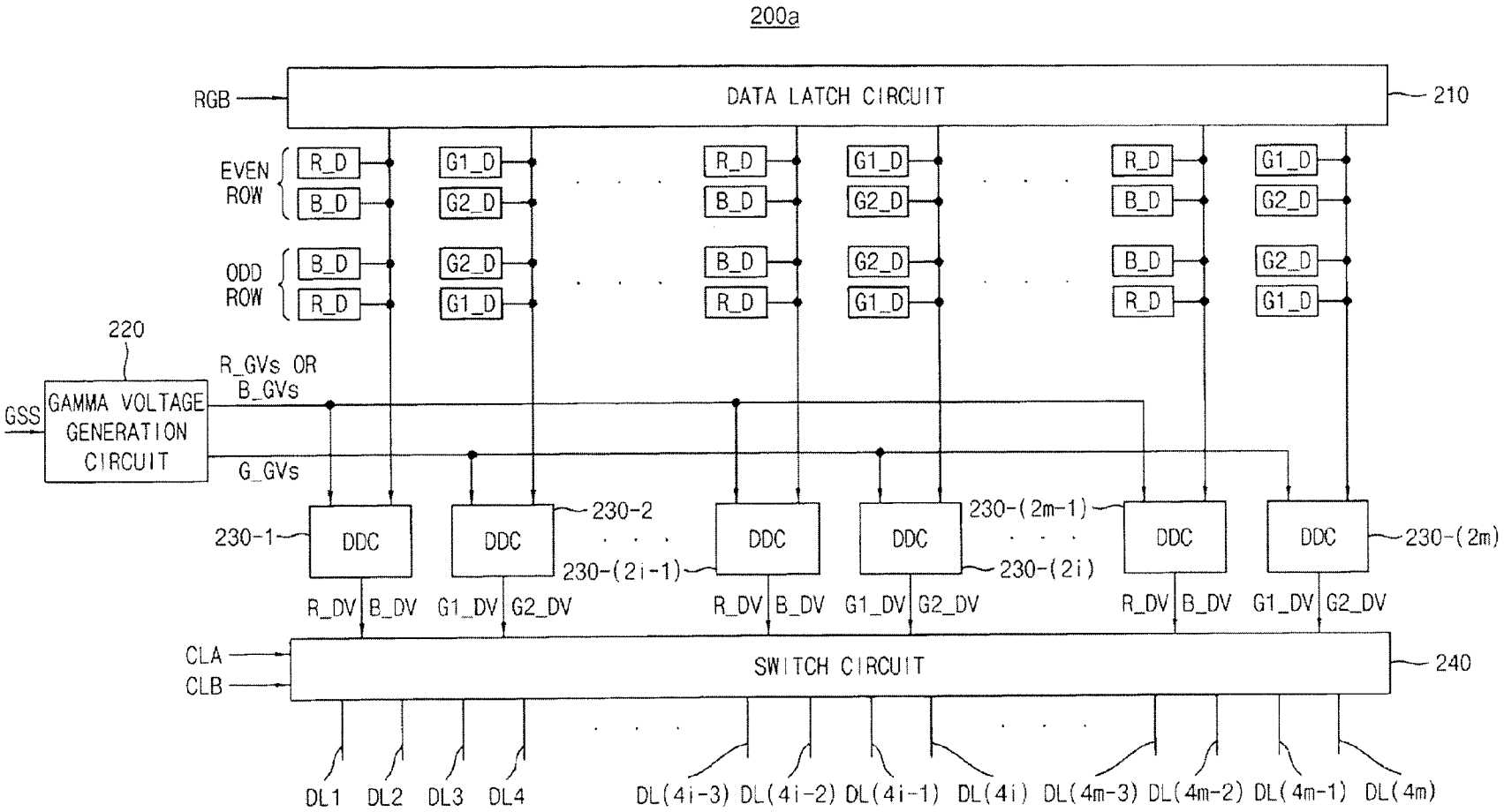
FIG. 8 is a block diagram for describing an exemplary embodiment operation of the source driver of FIG. 3.
Figure 9:
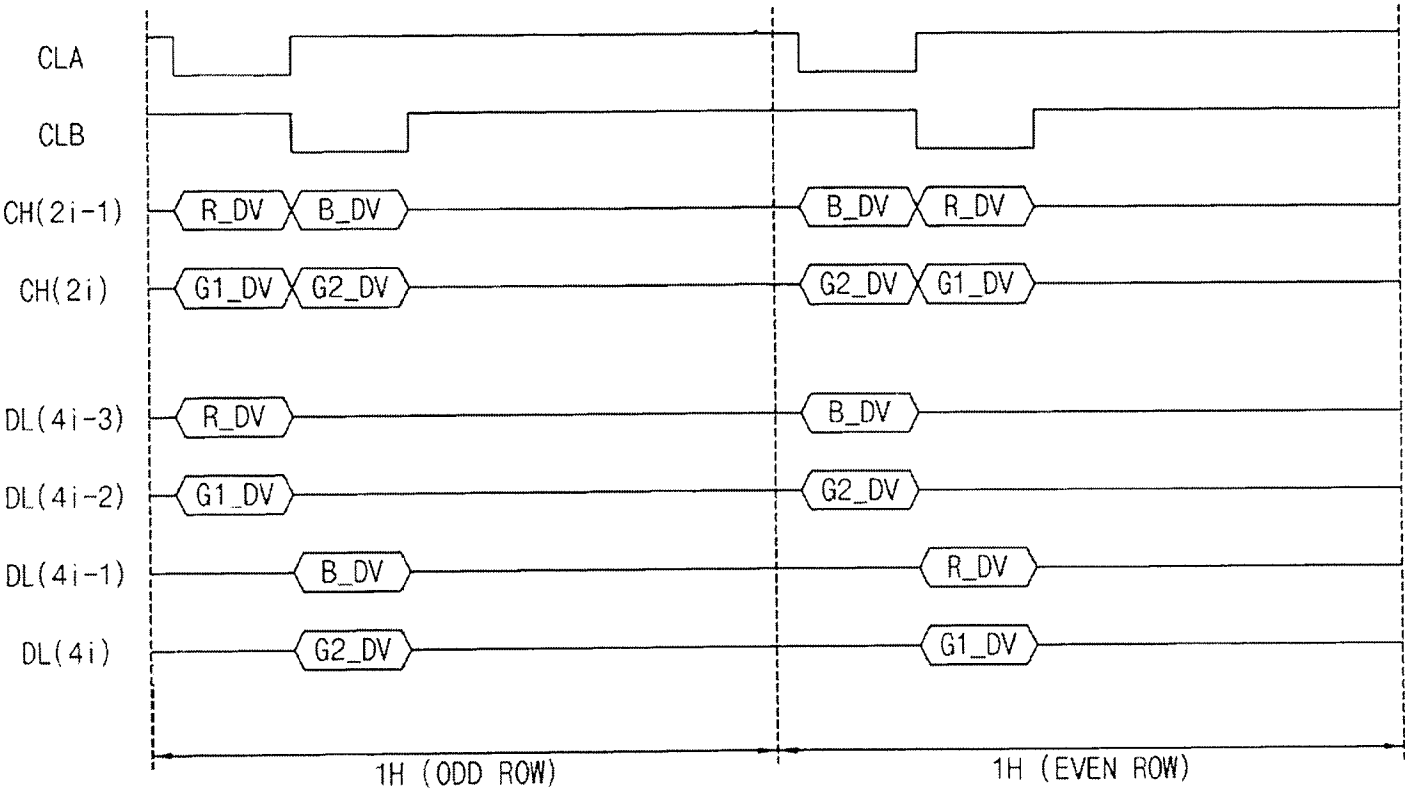
FIG. 9 is a timing diagram for describing an exemplary embodiment operation of the source driver of FIG. 8.

FIG. 8 is a block diagram for describing an example of an operation of the source driver of FIG. 3, and FIG. 9 is a timing diagram for describing an operation of the source driver of FIG. 8.

In FIG. 9, CH(2i−1) represents an output signal of the (2i−1)-th data driving circuit 230-(2i−1), and CH(2i) represents an output signal of the (2i)-th data driving circuit 230-(2i).

Referring to FIGS. 8 and 9, in a source driver 200*a*, the order in which the data latch circuit 210 outputs the red image data R_D and the blue image data B_D during an odd horizontal period, which corresponds to odd rows of the display panel 100, may be opposite to the order in which the data latch circuit 210 outputs the red image data R_D and the blue image data B_D during an even horizontal period, which corresponds to even rows of the display panel 100. That is, the order in which each of the (2k−1)-th data driving circuits 230-(2k−1) receives the red image data R_D and the blue image data B_D during the odd horizontal period may be opposite to the order in which each of the (2k−1)-th data driving circuits 230-(2k−1) receives the red image data R_D and the blue image data B_D during the even horizontal period.

For example, the data latch circuit 210 may output the red image data R_D and the first green image data G1_D, and then output the blue image data B_D and the second green image data G2_D during the odd horizontal period. On the other hand, the data latch circuit 210 may output the blue image data B_D and the second green image data G2_D, and then output the red image data R_D and the first green image data G1_D during the even horizontal period.

In this case, the order in which the first selection signal CLA and the second selection signal CLA are alternately activated during the odd horizontal period may be the same as the order in which the first selection signal CLA and the second selection signal CLB are alternately activated during the even horizontal period. For example, the first selection signal CLA may be activated, and then the second selection signal CLB may be activated in every horizontal period.

Referring to FIG. 9, in the odd horizontal period, while the first selection signal CLA is activated to a logic low level, the (2i−1)-th data driving circuit 230-(2i−1) may output the R driving voltage R_DV and the (2i)-th data driving circuit 230-(2i) may output the G1 driving voltage G1_DV.

Since the first selection signal CLA is activated to the logic low level, the (2i−1)-th demultiplexer 241-(2i−1) may output the R driving voltage R_DV to the (4i−3)-th data line DL(4i−3) and the (2i)-th demultiplexer 241-(2i) may output the G1 driving voltage G1_DV to the (4i−2)-th data line DL(4i−2).

After that, while the second selection signal CLB is activated to the logic low level, the (2i−1)-th data driving circuit 230-(2i−1) may output the B driving voltage B_DV and the (2i)-th data driving circuit 230-(2i) may output the G2 driving voltage G2_DV.

Since the second selection signal CLB is activated to the logic low level, the (2i−1)-th demultiplexer 241-(2i−1) may output the B driving voltage B_DV to the (4i−1)-th data line DL(4i−1) and the (2i)-th demultiplexer 241-(2i) may output the G2 driving voltage G2_DV to the (4i)-th data line DL(4i).

In the even horizontal period, while the first selection signal CLA is activated to the logic low level, the (2i−1)-th data driving circuit 230-(2i−1) may output the B driving voltage B_DV and the (2i)-th data driving circuit 230-(2i) may output the G2 driving voltage G2_DV.

Since the first selection signal CLA is activated to the logic low level, the (2i−1)-th demultiplexer 241-(2i−1) may output the B driving voltage B_DV to the (4i−3)-th data line DL(4i−3) and the (2i)-th demultiplexer 241-(2i) may output the G2 driving voltage G2_DV to the (4i−2)-th data line DL(4i−2).

After that, while the second selection signal CLB is activated to the logic low level, the (2i−1)-th data driving circuit 230-(2i−1) may output the R driving voltage R_DV and the (2i)-th data driving circuit 230-(2i) may output the G1 driving voltage G1_DV.

Since the second selection signal CLB is activated to the logic low level, the (2i−1)-th demultiplexer 241-(2i−1) may output the R driving voltage R_DV to the (4i−1)-th data line DL(4i−1) and the (2i)-th demultiplexer 241-(2i) may output the G1 driving voltage G1_DV to the (4i)-th data line DL(4i).

As described above with reference to FIGS. 8 and 9, the data latch circuit 210 included in the source driver 200*a* may output the R driving voltage R_DV and the B driving voltage B_DV in an opposite order in the odd horizontal period and the even horizontal period, and the controller 400 may activate the first selection signal CLA and the second selection signal CLB in the same order in the odd horizontal period and the even horizontal period.

Therefore, the source driver 200*a* may be able to drive the display panel 100 coupled to the plurality of data lines DL1~DL(4m) using the first through (2m)-th data driving circuits 230-1~230-(2m), the number of which is half of the number of the plurality of data lines DL1~DL(4m).

Figure 10:
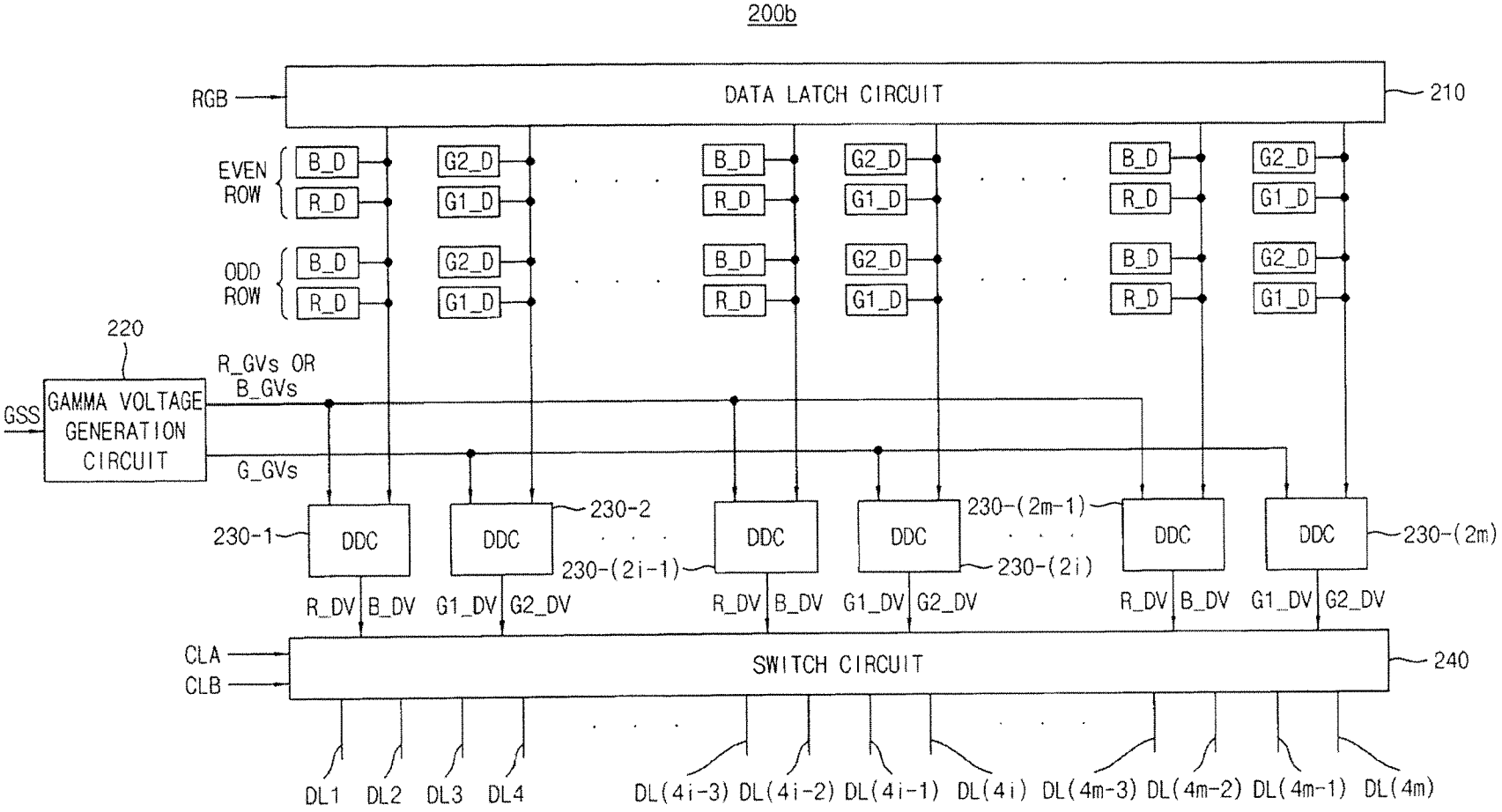
FIG. 10 is a block diagram for describing an exemplary embodiment operation of the source driver of FIG. 3.
Figure 11:
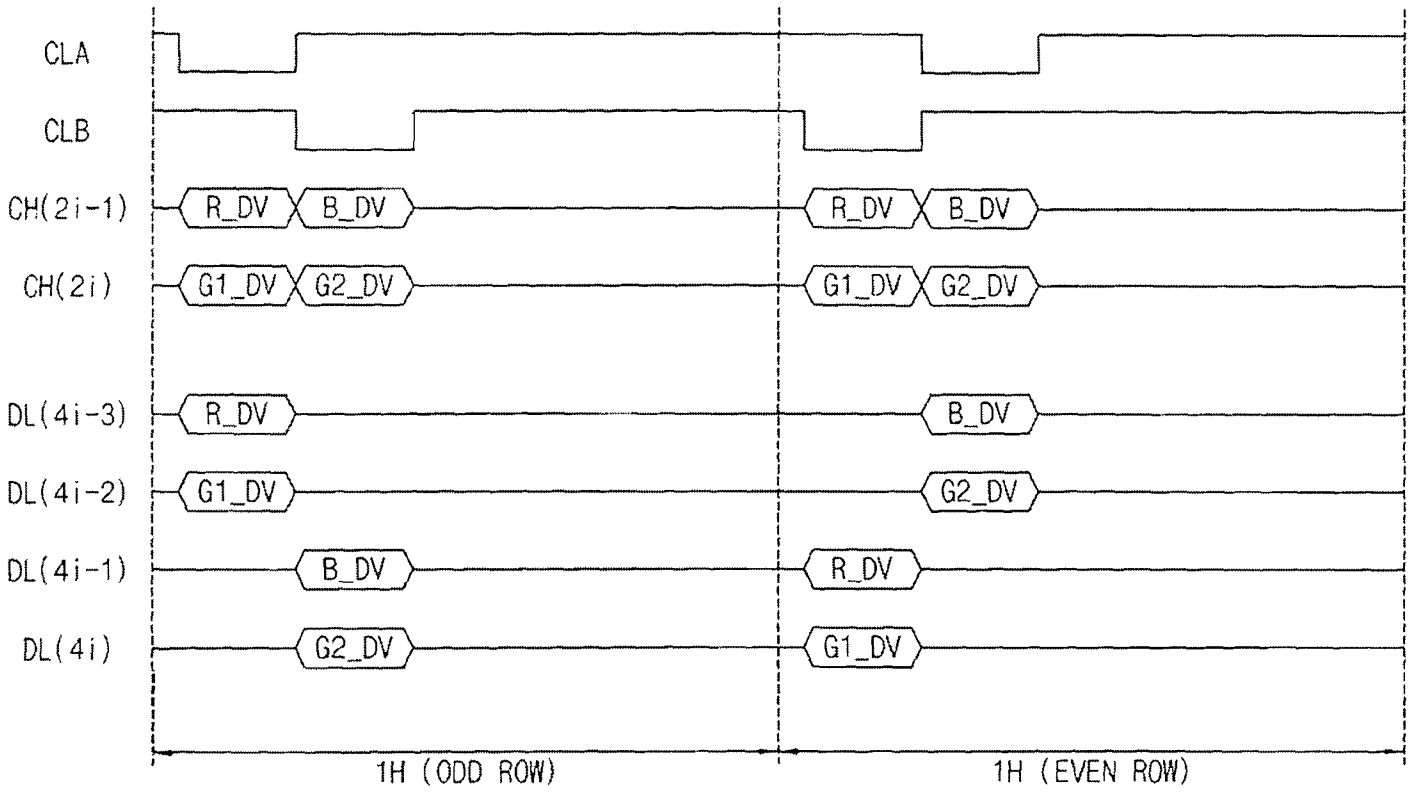
FIG. 11 is a timing diagram for describing an exemplary embodiment operation of the source driver of FIG. 10.

FIG. 10 is a block diagram for describing another example of an operation of the source driver of FIG. 3, and FIG. 11 is a timing diagram for describing an operation of the source driver of FIG. 10.

In FIG. 11, CH(2i−1) represents an output signal of the (2i−1)-th data driving circuit 230-(2i−1), and CH(2i) represents an output signal of the (2i)-th data driving circuit 230-(2i).

Referring to FIGS. 10 and 11, in a source driver 200*b*, the order in which the data latch circuit 210 outputs the red image data R_D and the blue image data B_D during an odd horizontal period, which corresponds to odd rows of the display panel 100, may be the same as the order in which the data latch circuit 210 outputs the red image data R_D and the blue image data B_D during an even horizontal period, which corresponds to even rows of the display panel 100. That is, the order in which each of the (2k−1)-th data driving circuits 230-(2k−1) receives the red image data R_D and the blue image data B_D during the odd horizontal period may be the same as the order in which each of the (2k−1)-th data driving circuits 230-(2k−1) receives the red image data R_D and the blue image data B_D during the even horizontal period.

For example, the data latch circuit 210 may output the red image data R_D and the first green image data G1_D, and then output the blue image data B_D and the second green image data G2_D during every horizontal period regardless of the odd horizontal period and the even horizontal period.

In this case, the order in which the first selection signal CLA and the second selection signal CLA are alternately activated during the odd horizontal period may be opposite to the order in which the first selection signal CLA and the second selection signal CLB are alternately activated during the even horizontal period. For example, the first selection signal CLA may be activated and then the second selection signal CLB may be activated in the odd horizontal period, and the second selection signal CLB may be activated and then the first selection signal CLA may be activated in the even horizontal period.

Referring to FIG. 11, in the odd horizontal period, while the first selection signal CLA is activated to a logic low level, the (2i−1)-th data driving circuit 230-(2i−1) may output the R driving voltage R_DV and the (2i)-th data driving circuit 230-(2i) may output the G1 driving voltage G1_DV.

Since the first selection signal CLA is activated to the logic low level, the (2i−1)-th demultiplexer 241-(2i−1) may output the R driving voltage R_DV to the (4i−3)-th data line DL(4i−3) and the (2i)-th demultiplexer 241-(2i) may output the G1 driving voltage G1_DV to the (4i−2)-th data line DL(4i−2).

After that, while the second selection signal CLB is activated to the logic low level, the (2i−1)-th data driving circuit 230-(2i−1) may output the B driving voltage B_DV and the (2i)-th data driving circuit 230-(2i) may output the G2 driving voltage G2_DV.

Since the second selection signal CLB is activated to the logic low level, the (2i−1)-th demultiplexer 241-(2i−1) may output the B driving voltage B_DV to the (4i−1)-th data line DL(4i−1) and the (2i)-th demultiplexer 241-(2i) may output the G2 driving voltage G2_DV to the (4i)-th data line DL(4i).

In the even horizontal period, while the second selection signal CLB is activated to the logic low level, the (2i−1)-th data driving circuit 230-(2i−1) may output the R driving voltage R_DV and the (2i)-th data driving circuit 230-(2i) may output the G1 driving voltage G1_DV.

Since the second selection signal CLB is activated to the logic low level, the (2i−1)-th demultiplexer 241-(2i−1) may output the R driving voltage R_DV to the (4i−1)-th data line DL(4i−1) and the (2i)-th demultiplexer 241-(2i) may output the G1 driving voltage G1_DV to the (4i)-th data line DL(4i).

After that, while the first selection signal CLA is activated to the logic low level, the (2i−1)-th data driving circuit 230-(2i−1) may output the B driving voltage B_DV and the (2i)-th data driving circuit 230-(2i) may output the G2 driving voltage G2_DV.

Since the first selection signal CLA is activated to the logic low level, the (2i−1)-th demultiplexer 241-(2i−1) may output the B driving voltage B_DV to the (4i−3)-th data line DL(4i−3) and the (2i)-th demultiplexer 241-(2i) may output the G2 driving voltage G2_DV to the (4i−2)-th data line DL(4i−2).

As described above with reference to FIGS. 10 and 11, the data latch circuit 210 included in the source driver 200*b* may output the R driving voltage R_DV and the B driving voltage B_DV in the same order in the odd horizontal period and the even horizontal period, and the controller 400 may activate the first selection signal CLA and the second selection signal CLB in an opposite order in the odd horizontal period and the even horizontal period.

Therefore, the source driver 200*b* may be able to drive the display panel 100 coupled to the plurality of data lines DL1~DL(4m) using the first through (2m)-th data driving circuits 230-1~230-(2m), the number of which is half of the number of the plurality of data lines DL1-DL(4m).

Generally, red driving voltage corresponding to red color, green driving voltage corresponding to green color, and blue driving voltage corresponding to blue color are generated using gamma voltages in different voltage ranges. Therefore, if a data driving circuit included in a source driver generates driving voltages corresponding to different colors alternately, power consumption of the source driver may increase.

On the other hand, as described above with reference to FIGS. 1 to 11, the source driver 200 included in the display device 10 according to an exemplary embodiment may include the first through (2m)-th data driving circuits 230-1~230-(2m), the number of which is half of the number of the plurality of data lines DL1~DL(4m). Each of the first through (2m)-th data driving circuits 230-1~230-(2m) may generate two driving voltages during one horizontal period, and provide the two driving voltage to two different data lines. The (2k)-th data driving circuits 230-(2k), which correspond to a half of the first through (2m)-th data driving circuits 230-1~230-(2m), may output the G1 driving voltage G1_DV and the G2 driving voltage G2_DV, both of which correspond to green color, during each horizontal period. Therefore, power consumption of the source driver 200 may decrease as well as a size of the source driver 200 may decrease.

Figure 12:
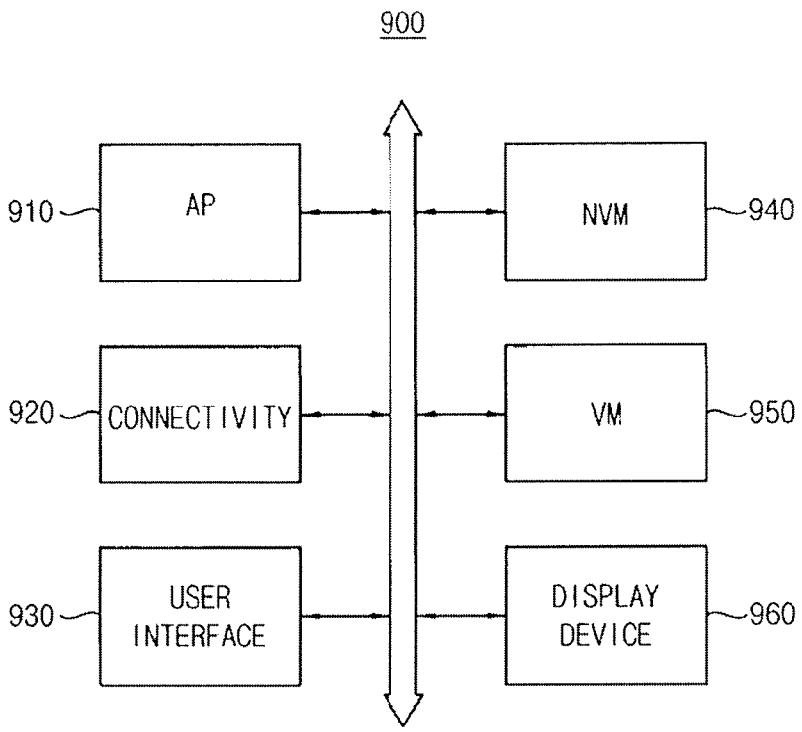
FIG. 12 is a block diagram illustrating a mobile system according to an exemplary embodiment.

FIG. 12 is a block diagram illustrating a mobile system according to exemplary embodiments.

Referring to FIG. 12, a mobile system 900 includes an application processor AP 910, a connectivity circuit 920, a user interface 930, a nonvolatile memory device NVM 940, a volatile memory device VM 950, and a display device 960. In some embodiments, the mobile system 900 may be a mobile phone, a smart phone, a personal digital assistant (PDA), a portable multimedia player (PMP), a digital camera, a music player, a portable game console, a navigation system, etc.

The nonvolatile memory device 940 may store a boot image for booting the mobile system 900. In addition, the nonvolatile memory device 940 may store multimedia data. For example, the nonvolatile memory device 940 may be an electrically erasable programmable read-only memory (EEPROM), a flash memory, a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), etc.

The application processor 910 may execute applications, such as a web browser, a game application, a video player, etc. In addition, the application processor 910 may read the multimedia data from the nonvolatile memory device 940, generate input data corresponding to the multimedia data, and provide the input data to the display device 960. In some embodiments, the application processor 910 may include a single core or multiple cores. For example, the application processor 910 may be a multi-core processor, such as a dual-core processor, a quad-core processor, a hexa-core processor, etc. The application processor 910 may include an internal or external cache memory.

The connectivity circuit 920 may perform wired or wireless communication with an external device. For example, the connectivity unit 920 may perform Ethernet communication, near field communication (NFC), radio frequency identification (RFID) communication, mobile telecommunication, memory card communication, universal serial bus (USB) communication, etc. In some embodiments, the connectivity unit 920 may include a baseband chipset that supports communications, such as global system for mobile communications (GSM), general packet radio service (GPRS), wideband code division multiple access (WCDMA), high speed downlink/uplink packet access (HSxPA), etc.

The volatile memory device 950 may store data processed by the application processor 910, or may operate as a working memory.

The user interface 930 may include at least one input device, such as a keypad, a touch screen, etc., and at least one output device, such as a speaker, a printer, etc.

The display device 960 may display the input data provided from the application processor 910. The display device 960 may be implemented with the display device 10 of FIG. 1. A structure and an operation of the display device 10 of FIG. 1 are described above with reference to FIGS. 1 to 11. Therefore, a detail description of the display device 960 will be omitted.

In some embodiments, the mobile system 900 may further include an image processor, and/or a storage device, such as a memory card, a solid state drive (SSD), etc.

In some embodiments, the mobile system 900 and/or components of the mobile system 900 may be packaged in various forms, such as package on package (PoP), ball grid arrays (BGAs), chip scale packages (CSPs), plastic leaded chip carrier (PLCC), plastic dual in-line package (PDIP), die in waffle pack, die in wafer form, chip on board (COB), ceramic dual in-line package (CERDIP), plastic metric quad flat pack (MQFP), thin quad flat pack (TQFP), small outline IC (SOIC), shrink small outline package (SSOP), thin small outline package (TSOP), system in package (SIP), multi chip package (MCP), wafer-level fabricated package (WFP), or wafer-level processed stack package (WSP).

Figure 13:
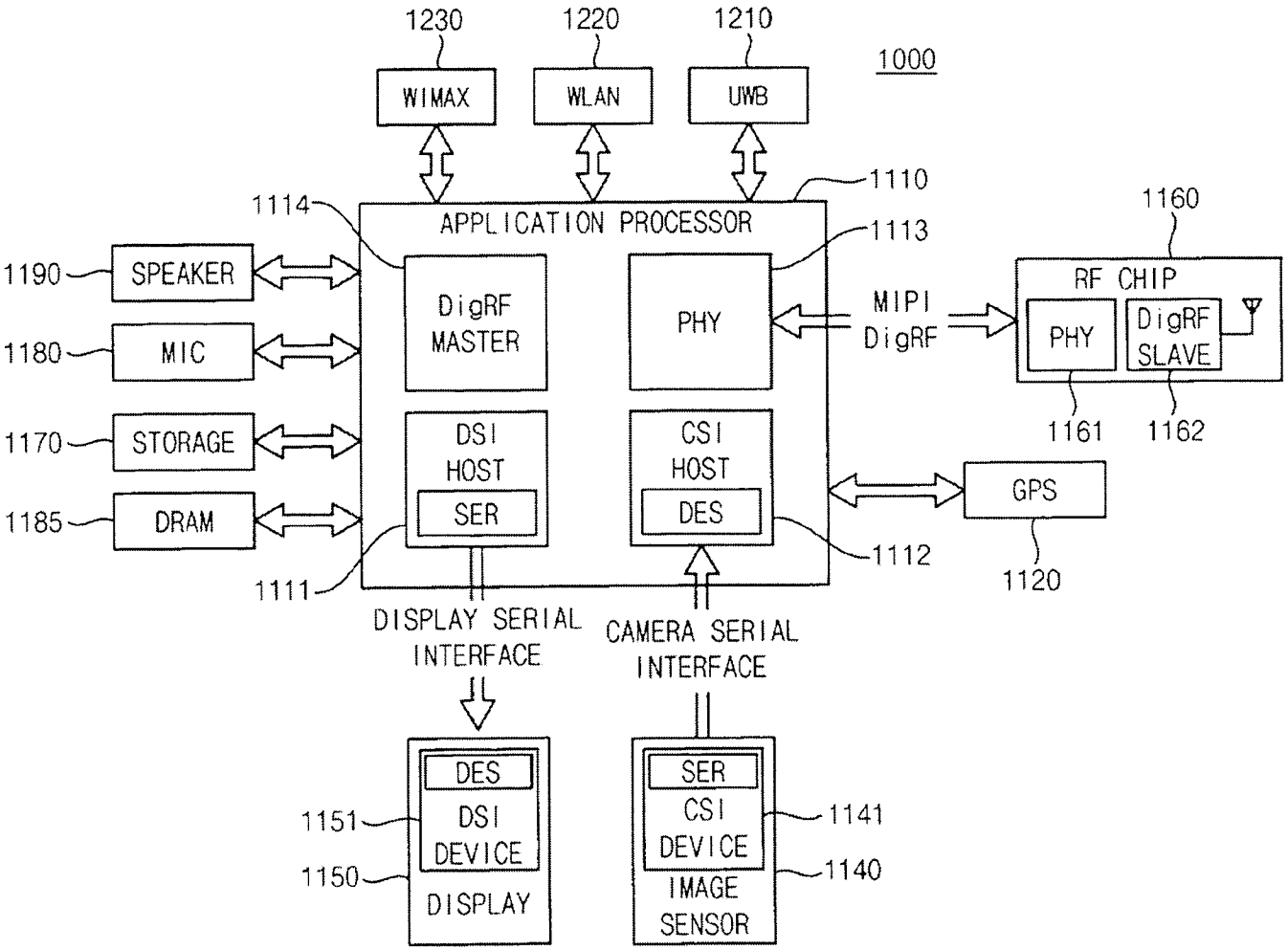
FIG. 13 is a block diagram illustrating an exemplary embodiment interface used in a mobile system of FIG. 12.

FIG. 13 is a block diagram illustrating an example of an interface used in a mobile system of FIG. 12.

Referring to FIG. 13, a mobile system 1000 may be implemented by a data processing device (e.g., a cellular phone, a personal digital assistant, a portable multimedia player, a smart phone, etc.) that uses or supports a mobile industry processor interface (MIPI) interface. The mobile system 1000 may include an application processor 1110, an image sensor 1140, a display device 1150, etc.

A CSI host 1112 of the application processor 1110 may perform a serial communication with a CSI device 1141 of the image sensor 1140 via a camera serial interface (CSI). In some embodiments, the CSI host 1112 may include a deserializer (DES), and the CSI device 1141 may include a serializer (SER). A DSI host 1111 of the application processor 1110 may perform a serial communication with a DSI device 1151 of the display device 1150 via a display serial interface (DSI). In an exemplary embodiment, the DSI host 1111 may include a serializer (SER), and the DSI device 1151 may include a deserializer (DES).

The mobile system 1000 may further include a radio frequency (RF) chip 1160 performing a communication with the application processor 1110. A physical layer (PHY) 1113 of the mobile system 1000 and a physical layer (PHY) 1161 of the RF chip 1160 may perform data communications based on a MIPI DigRF. The application processor 1110 may further include a DigRF MASTER 1114 that controls the data communications according to the MIPI DigRF of the PHY 1161, and the RF chip 1160 may further include a DigRF SLAVE 1162 controlled by the DigRF MASTER 1114.

The mobile system 1000 may further include a global positioning system (GPS) 1120, a storage 1170, a MIC 1180, a DRAM device 1185, and a speaker 1190. In addition, the mobile system 1000 may perform communications using an ultra wideband (UWB) 1210, a wireless local area network (WLAN) 1220, a worldwide interoperability for microwave access (WIMAX) 1230, etc. However, the structure and the interface of the mobile system 1000 are not limited thereto.

The foregoing is illustrative of the present inventive concept and is not to be construed as limiting thereof. Although exemplary embodiments have been described, those of ordinary skill in the pertinent art will readily appreciate that many modifications are possible in the exemplary embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A gamma voltage generation circuit in a source driver for a display device, the gamma voltage generation circuit comprising:

a first gamma voltage generator configured to generate R gamma voltages and B gamma voltages alternately during one horizontal period based on a gamma selection signal, and to provide the R gamma voltages and the B gamma voltages to a first group of data driving circuits; and a second gamma voltage generator configured to generate G gamma voltages, and to provide the G gamma voltages to a second group of data driving circuits different from the first group of data driving circuits.

2. The gamma voltage generation circuit of claim 1, wherein the gamma selection signal has a first logic level during a first half of the one horizontal period, and has a second logic level during a second half of the one horizontal period.

3. The gamma voltage generation circuit of claim 1, wherein the first group of data driving circuits correspond to (2k−1)-th data driving circuits, the second group of data driving circuits correspond to (2k)-th data driving circuits, k is all positive integers equal to or smaller than m, and m is a positive integer.

4. The gamma voltage generation circuit of claim 1, wherein the second gamma voltage generator is configured to continuously generate the G gamma voltages during the one horizontal period.

5. A source driver for a display device, comprising:

a gamma voltage generation circuit configured to generate R gamma voltages, G gamma voltages, and B gamma voltages;

a first group of data driving circuits configured to consecutively receive both red image data and blue image data during one horizontal period, and to consecutively generate both a R driving voltage and a B driving voltage, which correspond to the red image data and the blue image data, using the R gamma voltages and the B gamma voltages, respectively, during the one horizontal period; and a second group of data driving circuits configured to consecutively receive both first green image data and second green image data during the one horizontal period, and to consecutively generate both a G1 driving voltage and a G2 driving voltage, which correspond to the first green image data and the second green image data, respectively, using the G gamma voltages during the one horizontal period.

6. The source driver of claim 5, wherein the first group of data driving circuits consecutively output the R driving voltage and the B driving voltage to switch circuit during an odd horizontal period and sequentially output the B driving voltage and the R driving voltage to switch circuit during an even horizontal period successive to the odd horizontal period.

7. The source driver of claim 5, wherein the first group of data driving circuits consecutively output the R driving voltage and the B driving voltage to switch circuit during an odd horizontal period and consecutively output the R driving voltage and the B driving voltage to the switch circuit during an even horizontal period successive to the odd horizontal period.

8. The source driver of claim 5, wherein the first group of data driving circuits correspond to (2k−1)-th data driving circuits, the second group of data driving circuits correspond to (2k)-th data driving circuits, k is all positive integers equal to or smaller than m, and m is a positive integer, and wherein the order in which each of the (2k−1)-th data driving circuits receives the red image data and the blue image data during an odd horizontal period is opposite to the order in which each of the (2k−1)-th data driving circuits receives the red image data and the blue image data during an even horizontal period.

9. The source driver of claim 5, wherein the first group of data driving circuits correspond to (2k−1)-th data driving circuits, the second group of data driving circuits correspond to (2k)-th data driving circuits, k is all positive integers equal to or smaller than m, and m is a positive integer, and wherein the order in which each of the (2k−1)-th data driving circuits receives the red image data and the blue image data during an odd horizontal period is the same as the order in which each of the (2k−1)-th data driving circuits receives the red image data and the blue image data during an even horizontal period.

10. The source driver of claim 5, wherein the gamma voltage generation circuit includes:

a first gamma voltage generator configured to generate R gamma voltages and B gamma voltages alternately during one horizontal period based on a logic level of a gamma selection signal, and to provide the R gamma voltages and the B gamma voltages to the first group of data driving circuits; and a second gamma voltage generator configured to generate G gamma voltages, and to provide the G gamma voltages to the second group of data driving circuits.

11. The source driver of claim 5, further comprising:

a data latch circuit configured to receive the red image data, the first green image data, the second green image data, and the blue image data, to consecutively provide the red image data and the blue image data to the first group of data driving circuits during the one horizontal period, and to consecutively provide the first green image data and the second green image data to the second group of data driving circuits during the one horizontal period.

12. A display device, comprising:

a display panel including red subpixels, green subpixels, and blue subpixels coupled to a plurality of gate lines and a plurality of data lines;

a gate driver configured to consecutively select the plurality of gate lines;

a source driver configured to provide a plurality of driving voltages to the plurality of data lines; and a controller configured to control the gate driver and the source driver, and to provide image data to the source driver, wherein the source driver includes a plurality of data driving circuits, the number of which is smaller than the number of the plurality of data lines, a first group of data driving circuits of the plurality of data driving circuits generate both a R driving voltage and a B driving voltage, which correspond to red image data and blue image data, respectively, that are consecutively received during one horizontal period, consecutively during the one horizontal period, and provide the R driving voltage and the B driving voltage consecutively to first different data lines from each other, and a second group of data driving circuits of the plurality of data driving circuits generate both a G1 driving voltage and a G2 driving voltage, which correspond to first green image data and second green image data, respectively, that are consecutively received during the one horizontal period, consecutively during the one horizontal period, and provide the G1 driving voltage and the G2 driving voltage consecutively to second different data lines from each other.

13. The display device of claim 12, wherein the first group of data driving circuits consecutively output the R driving voltage and the B driving voltage to switch circuit during an odd horizontal period and sequentially output the B driving voltage and the R driving voltage to switch circuit during an even horizontal period successive to the odd horizontal period.

14. The display driver circuit of claim 12, wherein the first group of data driving circuits consecutively output the R driving voltage and the B driving voltage to switch circuit during an odd horizontal period and consecutively output the R driving voltage and the B driving voltage to the switch circuit during an even horizontal period successive to the odd horizontal period.

15. The display device of claim 12, wherein the display panel has a structure including odd rows, in which red subpixels, green subpixels, and blue subpixels are arranged in an order of the red subpixel, the green subpixel, the blue subpixel, and the green subpixel, and even rows, in which the red subpixels, the green subpixels, and the blue subpixels are arranged in an order of the blue subpixel, the green subpixel, the red subpixel, and the green subpixel, and wherein the plurality of data lines includes first through (4m)-th data lines, where m is a positive integer.

16. The display device of claim 15, wherein the source driver includes:

a gamma voltage generation circuit configured to generate R gamma voltages, G gamma voltages, and B gamma voltages;

(2k−1)-th data driving circuits corresponding to the first group of data driving circuits, configured to consecutively receive both the red image data and the blue image data during the one horizontal period, and to consecutively generate both the R driving voltage and the B driving voltage, which correspond to the red image data and the blue image data, using the R gamma voltages and B gamma voltages, respectively, during the one horizontal period, k being all positive integers equal to or smaller than m; and (2k)-th data driving circuits corresponding to the second group of data driving circuits, configured to consecutively receive both the first green image data and the second green image data during the one horizontal period, and to consecutively generate both the G1 driving voltage and the G2 driving voltage, which correspond to the first green image data and the second green image data, respectively, using the G gamma voltages during the one horizontal period.

17. The display device of claim 16, further comprising:

a switch circuit configured to output the R driving voltage, the B driving voltage, the G1 driving voltage, and the G2 driving voltage, which are received from the first through (2m)-th data driving circuits during the one horizontal period, through different data lines from each other based on a first selection signal and a second selection signal provided by the controller, wherein the switch circuit is disposed on the display panel.

18. The display device of claim 17, wherein the switch circuit outputs the R driving voltage and the B driving voltage, which are received from the (2i−1)-th data driving circuit during the one horizontal period, through a (4i−3)-th data line and a (4i−1)-th data line, respectively, based on the first selection signal and the second selection signal, and outputs the G1 driving voltage and the G2 driving voltage, which are received from the (2i)-th data driving circuit during the one horizontal period, through a (4i−2)-th data line and a (4i)-th data line, respectively, based on the first selection signal and the second selection signal, where i is a positive integer equal to or smaller than m.

* * * * *